US007669901B2

(12) United States Patent
Paterson et al.

(10) Patent No.: US 7,669,901 B2
(45) Date of Patent: Mar. 2, 2010

(54) DOOR SAFETY LATCH FOR AN AIR CLEANER

(75) Inventors: Christopher M. Paterson, Biloxi, MS (US); John R. Bohlen, Long Beach, MS (US); Steve Irby, Gulfport, MS (US); Paul Moshenrose, Ocean Springs, MS (US); Owen T. Bourgeois, Pass Christian, MS (US)

(73) Assignee: Oreck Holdings, LLC, Cheyenne, WY (US)

( * ) Notice: Subject to any disclaimer, the term of this patent is extended or adjusted under 35 U.S.C. 154(b) by 569 days.

(21) Appl. No.: 11/492,405

(22) Filed: Jul. 25, 2006

(65) Prior Publication Data

US 2008/0023968 A1 Jan. 31, 2008

(51) Int. Cl.
*E05C 19/10* (2006.01)
*E05C 19/00* (2006.01)

(52) U.S. Cl. ..... 292/121; 292/98; 292/102; 292/108; 292/122; 292/124; 292/125; 292/128; 292/DIG. 37; 292/DIG. 38; 292/DIG. 63

(58) Field of Classification Search ..... 292/95, 292/98, 102, 108, 121, 122, 124–127, DIG. 37, 292/DIG. 38, DIG. 63
See application file for complete search history.

(56) References Cited

U.S. PATENT DOCUMENTS 754,721 A * 3/1904 Tower ..... 292/127
1,133,254 A * 3/1915 Backus ..... 292/127
1,198,509 A * 9/1916 Anderson ..... 292/179
1,664,576 A * 4/1928 Stuart et al. ..... 292/127
2,313,711 A * 3/1943 Jacobi ..... 70/145
2,803,956 A * 8/1957 Womer ..... 70/63
3,044,287 A * 7/1962 Pelcin ..... 70/99
3,151,901 A * 10/1964 Aldgren ..... 292/124
3,330,585 A * 7/1967 Pollin ..... 292/164
3,339,956 A * 9/1967 Bencene et al. ..... 292/127
3,463,530 A * 8/1969 Modes ..... 292/128
4,179,143 A * 12/1979 Shy ..... 292/179
4,473,382 A 9/1984 Cheslock
5,018,241 A * 5/1991 Baines ..... 16/82
5,263,346 A * 11/1993 Sato et al. ..... 70/210
5,457,971 A * 10/1995 Yamada ..... 70/208
5,626,374 A * 5/1997 Kim ..... 292/170
5,722,705 A * 3/1998 Deguchi ..... 292/87
5,785,398 A * 7/1998 Park ..... 312/223.2
6,158,105 A * 12/2000 Suh ..... 29/453
6,296,334 B1 * 10/2001 Liao ..... 312/223.2
7,347,460 B2 * 3/2008 Ala ..... 292/216

* cited by examiner

*Primary Examiner*—Carlos Lugo
(74) *Attorney, Agent, or Firm*—Winston & Strawn LLP

(57) ABSTRACT

A door safety latch for air cleaner is provided. The door safety latch includes a latch arm including a latch projection, with the latch arm configured to pivot with respect to a door of the air cleaner, and a slider that traps a portion of the latch arm. The slider is configured to hold the latch arm in a first, latched position and further configured to pivot the latch arm to a second, unlatched position. The door safety latch further includes a release button that includes a stop shoulder. The release button is biased to a normally extended position with the stop shoulder blocking movement of the slider and the latch arm to the second, unlatched position.

15 Claims, 9 Drawing Sheets

SECTION AA

DOOR SAFETY LATCH FOR AN AIR CLEANER

TECHNICAL FIELD

The present invention relates to an air cleaner, and more particularly, to a door safety latch for an air cleaner.

BACKGROUND OF THE INVENTION

Air cleaners are widely used for removing foreign substances from the air. The foreign substances can include pollen, dander, smoke, pollutants, dust, etc. In addition, an air cleaner can be used to circulate room air. An air cleaner can be used in many settings, including at home, in offices, workrooms, etc.

An air cleaner can include any type of mechanical filter element comprising a mesh, a weave, a foam, etc. An air cleaner can further include electrical air cleaning components, such as a collector cell that removes dirt and debris from the airflow of the air cleaner. A collector cell can include an ionizer and/or an electrostatic precipitator.

The electrostatic precipitator and the ionizer operate by creating high-voltage electrical fields, typically in excess of 5,000 volts. Dirt and debris in the air becomes ionized when it is brought into this high voltage electrical field by an airflow. Charge plates or electrodes in the electrostatic precipitator air cleaner, such as positive and negative plates or positive and ground plates, create the electrical field and one of the electrode polarities attracts the ionized dirt and debris. Because the electrostatic precipitator comprises electrodes or plates through which airflow can easily and quickly pass, only a low amount of energy is required to provide airflow through the electrostatic precipitator. As a result, foreign objects in the air can be efficiently and effectively removed.

The ionizer can comprise charge wires and ground plates, wherein the ionizer charges particles in the airflow before the airflow enters the electrostatic precipitator. The charging of the particles can neutralize or kill living organisms. The ionized particles of the airflow are subsequently attracted to ground potential surfaces. As a result, the electrically charged dirt and debris is more likely to be pulled out of the airflow when the airflow passes through the electrostatic precipitator.

Periodically, the electrostatic precipitator can be removed and cleaned. Therefore, the air cleaner must include some manner of access door that allows persons to access internal components. The door further allows removal of the electrostatic precipitator and other filter elements for cleaning, replacement, or other maintenance.

The high operational voltage level of a collector cell presents a safety concern in that it presents a significant danger of shock or electrocution. It is imperative that the air cleaner include sufficient safety features to prevent intentional and unintentional contact with any high voltage components. Specifically, the air cleaner must be designed so that small children, who cannot appreciate the danger and who cannot appreciate warning labels, cannot access the interior components.

The prior art has drawbacks. The prior art does not provide door latch that minimizes risk of contact with high voltage components. The prior art does not provide a door latch that is simple and compact, yet requires a relatively complex manipulation process that must be performed in sequence in order to open the door.

SUMMARY OF THE INVENTION

A door safety latch for air cleaner is provided according to an embodiment of the invention. The door safety latch comprises a latch arm including a latch projection, with the latch arm configured to pivot with respect to a door of the air cleaner, and a slider that traps a portion of the latch arm. The slider is configured to hold the latch arm in a first, latched position and further configured to pivot the latch arm to a second, unlatched position. The door safety latch further comprises a release button that includes a stop shoulder. The release button is biased to a normally extended position with the stop shoulder blocking movement of the slider and the latch arm to the second, unlatched position.

A method of forming a door safety latch for an air cleaner is provided according to an embodiment of the invention. The method comprises providing a latch arm including a latch projection, with the latch arm configured to pivot with respect to a door of the air cleaner, and providing a slider that traps a portion of the latch arm. The slider is configured to hold the latch arm in a first, latched position and further configured to pivot the latch arm to a second, unlatched position. The method further comprises providing a release button that includes a stop shoulder. The release button is biased to a normally extended position with the stop shoulder blocking movement of the slider and the latch arm to the second, unlatched position. The release button is first pushed and the slider is then slid to the second, unlatched position in order to release the door safety latch.

A method of releasing a door safety latch in an air cleaner is provided according to an embodiment of the invention. The method comprises receiving a button depression in a release button of the air cleaner, with the button depression moving a stop shoulder out of a slide path of a slider of the door safety latch, and subsequently receiving a slide actuation force in the slider. The slider pivots a latch arm in order to release a corresponding door of the air cleaner.

An air cleaner door is provided according to an embodiment of the invention. The air cleaner door comprises a door panel and one or more tool retainer brackets in the door panel. The one or more tool retainer brackets are adapted to receive and hold one or more cleaning tools.

A method of forming an air cleaner door is provided according to an embodiment of the invention. The method comprises providing a door panel and providing one or more tool retainer brackets in the door panel. The one or more tool retainer brackets are adapted to receive and hold one or more cleaning tools.

BRIEF DESCRIPTION OF THE DRAWINGS

The same reference number represents the same element on all drawings. It should be noted that the drawings are not necessarily to scale.

DETAILED DESCRIPTION OF THE INVENTION

FIGS. 1-9 and the following descriptions depict specific embodiments to teach those skilled in the art how to make and use the best mode of the invention. For the purpose of teaching inventive principles, some conventional aspects have been simplified or omitted. Those skilled in the art will appreciate variations from these embodiments that fall within the scope of the invention. Those skilled in the art will also appreciate that the features described below can be combined in various ways to form multiple variations of the invention. As a result, the invention is not limited to the specific embodiments described below, but only by the claims and their equivalents.

Figure 1:
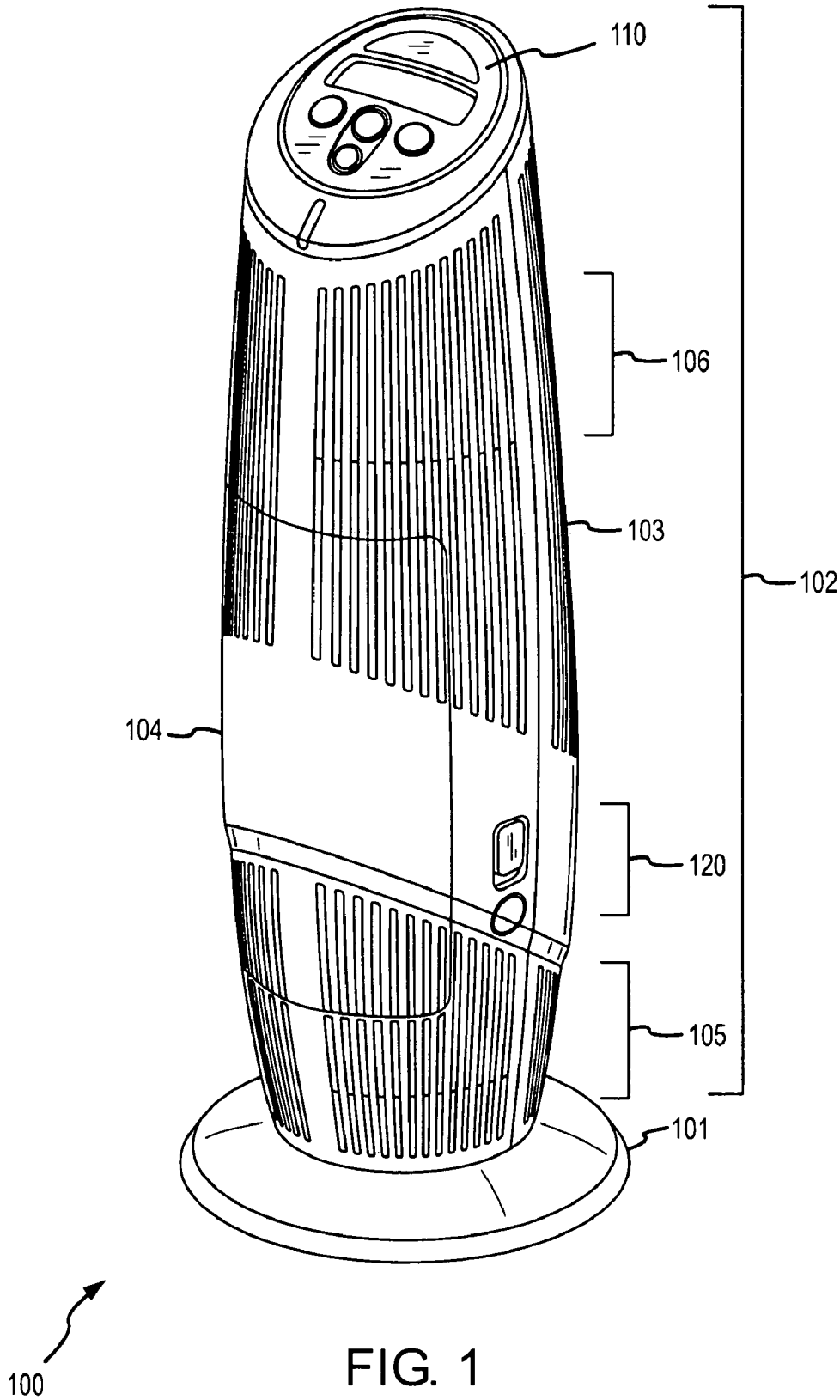
FIG. 1 shows an air cleaner according to an embodiment of the invention.

FIG. 1 shows an air cleaner 100 according to an embodiment of the invention. The air cleaner 100 in the embodiment shown includes a base portion 101 and a tower portion 102. The tower portion 102 can be generally vertically positioned and elongate in shape. In one embodiment, the tower portion 102 can be substantially cylindrical in shape. However, it should be understood that the air cleaner 100 can comprise any configuration, such as substantially rectangular, substantially round, a tower, etc. The air cleaner 100 can comprise a floor air cleaner model, a table top air cleaner model, a portable or personal air cleaner model, etc.

The tower portion 102 includes an external shell 103, one or more doors 104, and a control panel 110. The tower portion 102 further includes an air inlet 105 and an air outlet 106. Air is drawn in through the air inlet 105, is cleaned inside the tower portion 102, and the cleaned air is exhausted from the air outlet 106. However, it should be understood that the air cleaner 100 can comprise other shapes, configurations, and designs, and the tower configuration is shown merely for illustration.

The air inlet 105 is shown as being at the lower end of the tower portion 102. However, it should be understood that alternatively the relative positions of the air inlet 105 and the air outlet 106 could be interchanged.

The air cleaner 100 further includes a door safety latch 120. The door safety latch 120 latches the door 104 in a closed position. However, due to the design of the door safety latch 120, the door 104 cannot be easily or quickly opened. Advantageously, small children will be prevented from opening the door 104 and potentially coming into contact with high voltage electrical components inside the air cleaner 100.

The door safety latch 120 is simple and compact. However, the door safety latch 120 requires a relatively complex manipulation process that must be performed, in sequence, in order to open the door. Two separate steps must be performed in sequence in order to release the door safety latch 120 and open the door 104. The operation of the door safety latch 120 is described below in conjunction with FIG. 2.

Figure 2:
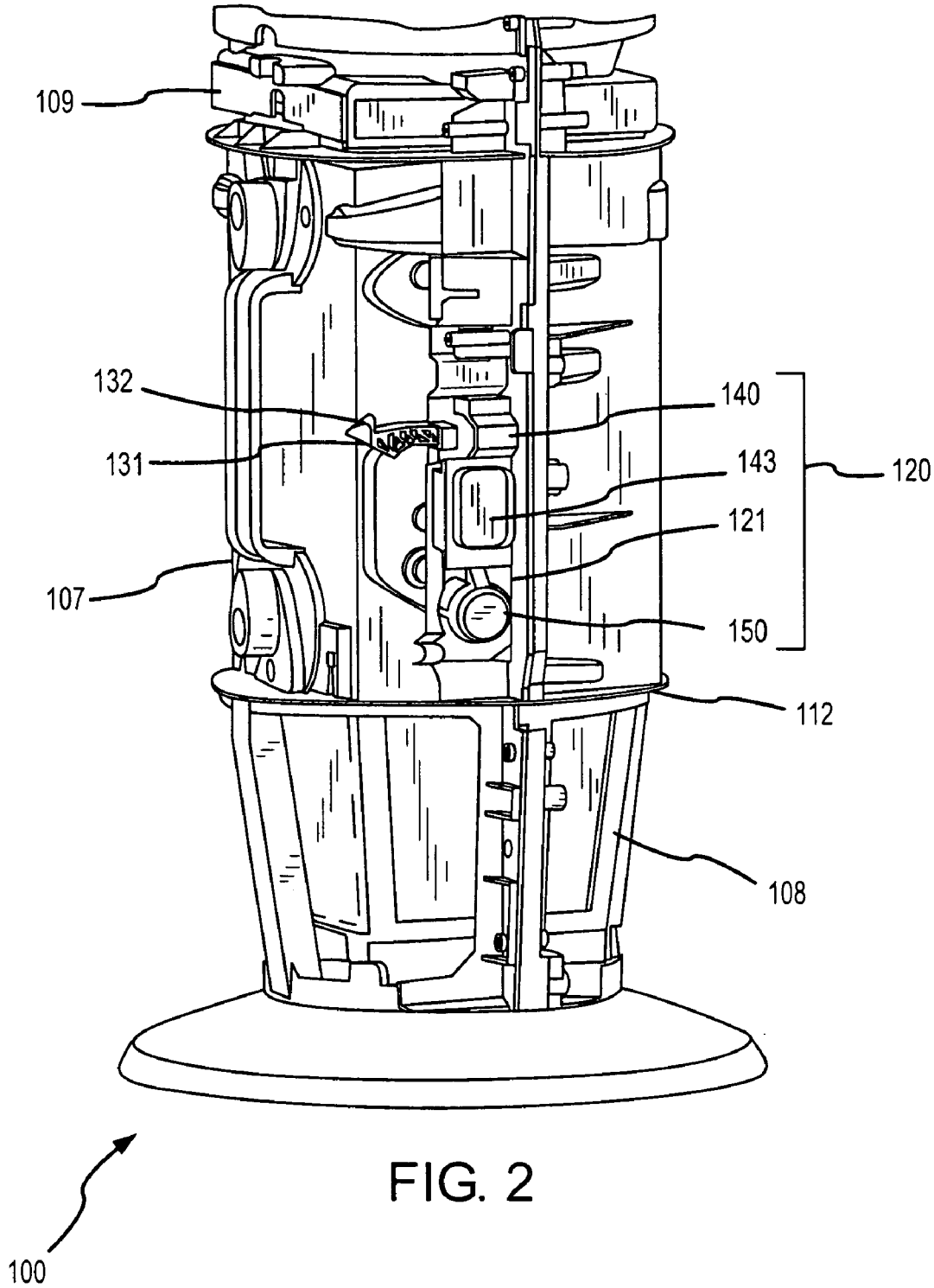
FIG. 2 shows components of the door safety latch according to an embodiment of the invention.

FIG. 2 shows components of the door safety latch 120 according to an embodiment of the invention. The door safety latch 120 in the embodiment shown includes a latch frame 121, a latch arm 131, a slider 140, and a release button 150. The air cleaner 100 in the embodiment shown further includes a pre-filter 108, a collector cell 107, and a post filter 109. The collector cell 107 can include a combined ionizer (i.e., a pre-ionizer) and an electrostatic precipitator. These two components operate at very high voltages and present a risk of shock or electrocution. The post filter 109 can include a mechanical filter mesh, an odor absorber element, an ozone filter, a volatile organic compound (VOC) filter, or any combination thereof.

The latch frame 121 is mounted to either a chassis 112 or the external shell 103 of the air cleaner 100. The latch frame 121 can be permanently or removably mounted to the chassis 112 or to the external shell 103. The latch arm 131, the slider 140, and the release button 150 mount to the latch frame 121. The external shell 103 in FIG. 1 is affixed to the chassis 112, covering most of the door safety latch 120, including the latch frame 121.

Figure 3:
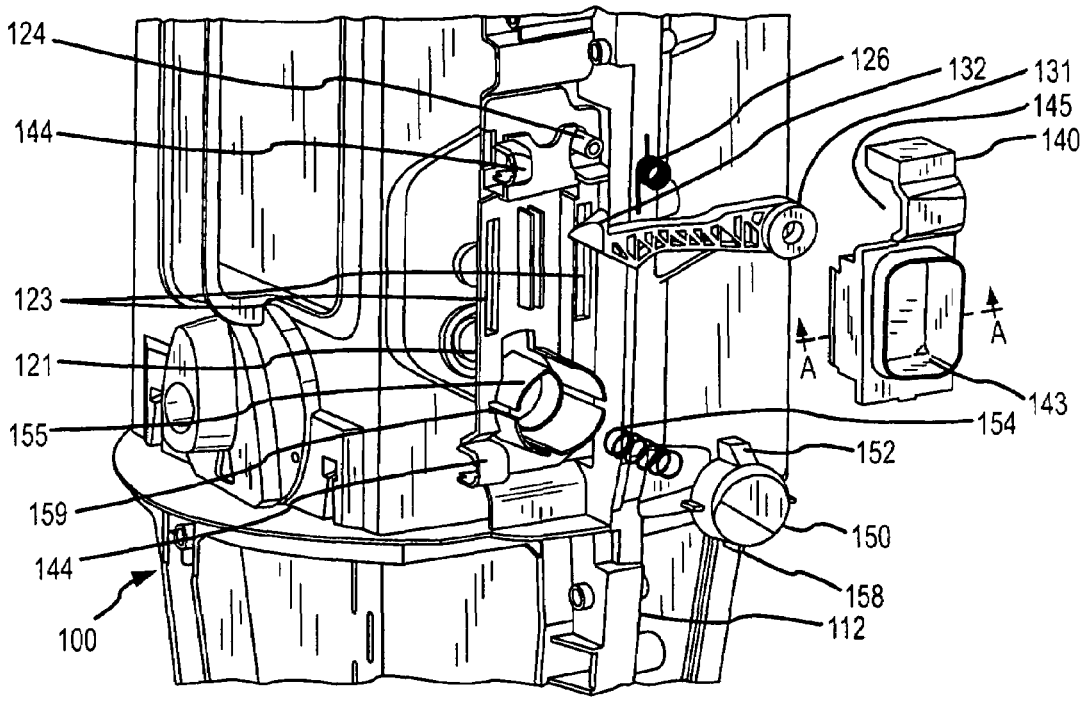
FIG. 3 is an exploded view of the door safety latch according to an embodiment of the invention.

The latch arm 131 is pivotally mounted to the latch frame 121 by a pivot 124 (see FIG. 3). The latch arm 131 can be biased upward by a latch arm biasing device 126. The upward biasing maintains the latch arm 131 at a first, latched position (i.e., a normal position). When the door 104 is closed, the door 104 can temporarily deflect the latch arm 131 downward, whereupon the latch arm biasing device 126 moves the latch arm 131 upward again, latching the door 104 to the external shell 103.

The latch arm 131 includes a latch projection 132. The latch projection 132 can catch a portion of a door, such as the door 104, in order to latch and retain the door (see FIGS. 6 and 7).

The slider 140 is slidably mounted to the latch frame 121. The slider 140 can slide up and down in the figure with respect to the latch frame 121 and the air cleaner 100. The slider 140 further includes a finger well 143 that is used to move the slider 140. A user places a finger in the finger well 143 and can therefore place a sliding force on the slider 140.

The slider 140 further includes a latch arm channel 145 (see FIG. 3) that traps the latch arm 131. The latch arm channel 145 therefore generates the pivoting movement of the latch arm 131 when the slider 140 is moved vertically. When the slider 140 is moved up or down, the latch arm 131 is forced to correspondingly pivot up or down.

The latch arm biasing device 126 can place a biasing force on the slider 140 that urges the slider 140 upward. The latch arm biasing device 126 can therefore serve to hold the latch arm 131 upward in a first, latched position (see FIG. 6). A predetermined sliding force must therefore be placed on the slider 140 in order to overcome the first biasing force and move the latch arm 131 downward to a second, unlatched position (see FIG. 7).

The release button 150 is movably retained to the latch frame 121 in a button receptacle 155. The external shell 103 in some embodiments traps the release button 150 in the button receptacle 155. The release button 150 can move inward toward, and outward away from, the latch frame 121 and the chassis 112. The release button 150 is normally biased outward by a button biasing device 154. A predetermined push force must be placed on the release button 150 in order to push the release button 150 inward, against the button biasing device 154.

The release button 150 includes a stop shoulder 152. The stop shoulder 152 blocks a downward sliding motion of the slider 140 when the release button 150 is not depressed. When the release button 150 is depressed, the stop shoulder 152 is moved inward out of a path of the slider 140. As a result, the slider 140 and the latch arm 131 can move downward and can release the door 104.

Two separate manipulations of the door safety latch 120 are required in order to operate and open the door 104. First, the release button 150 must be depressed, where the button depression moves the stop shoulder 152 out of the path of the slider 140. Then, the slider 140 must be slid in opposition to the latch arm biasing device 126, pulling the latch arm 131 to the second, unlatched position. When the latch arm 131 is pulled in opposition to the latch arm biasing device 126, the latch projection 132 clears a corresponding door portion, and the door 104 is released.

FIG. 3 is an exploded view of the door safety latch 120 according to an embodiment of the invention. This figure shows the latch frame 121 in position to be affixed or removably affixed to either the chassis 112 or to the external shell 103. The latch frame 121 in some embodiments includes one or more fastener features 144 and is configured to be held in place by one or more corresponding fasteners (not shown) that engage the fastener features 144. However, other mounting components and procedures are contemplated and are within the scope of the description and claims.

This figure further shows the stop shoulder 152 of the release button 150 and the latch arm channel 145 of the slider 140. In addition, this figure shows the latch arm biasing device 126 and the button biasing device 154.

Figure 4:
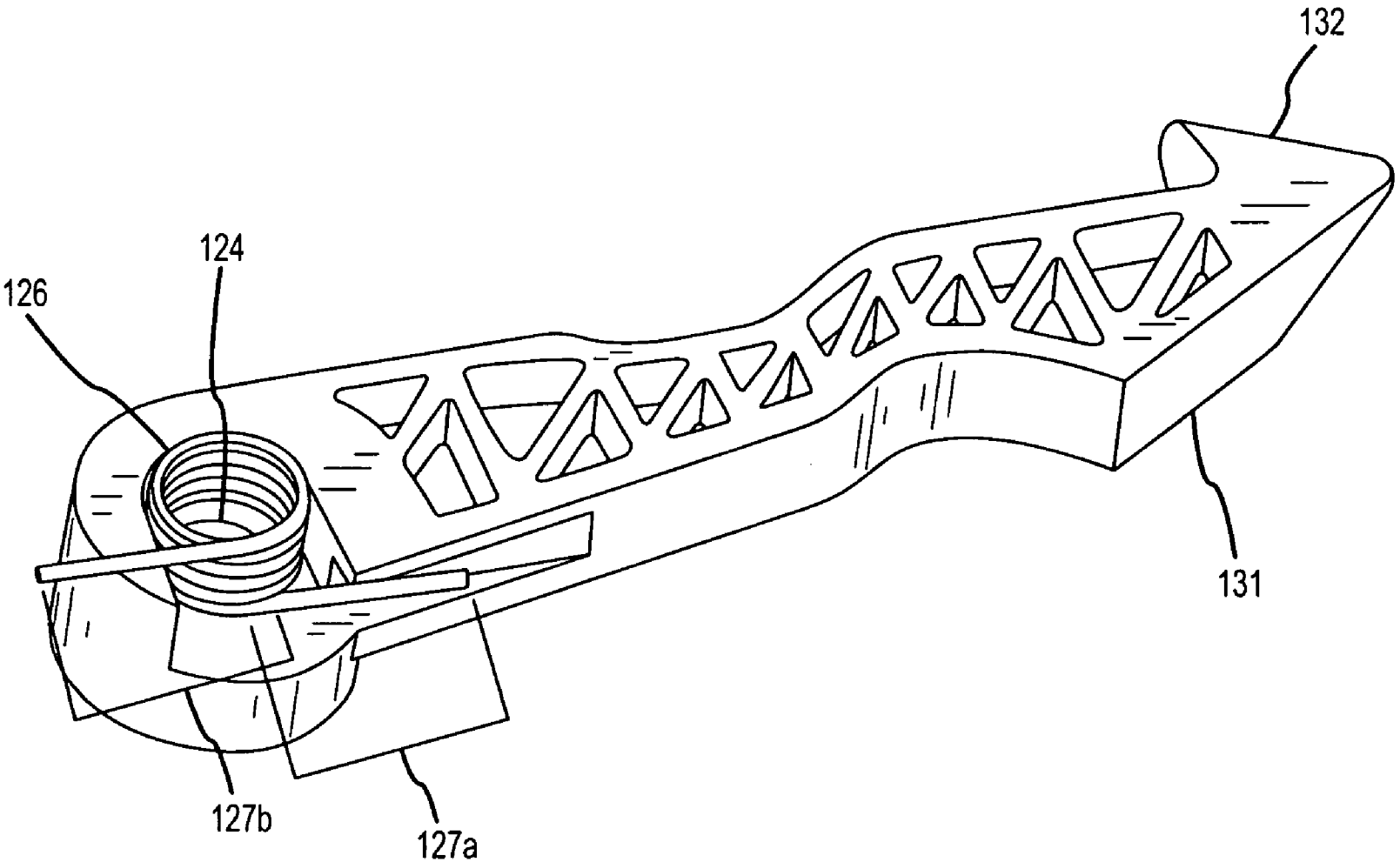
FIG. 4 shows a latch arm biasing device according to an embodiment of the invention.

The latch arm biasing device 126 can comprise a rotationally acting biasing device acting on the latch frame 121 and the latch arm 131 (also see FIG. 4). The latch arm biasing device 126 provides a biasing force that returns the latch arm 131 to a normal upward position, wherein the latch projection 132 engages a portion of the door 104. Alternatively, the latch arm biasing device 126 can comprise a linear acting biasing device that is located between the latch frame 121 and a bottom surface of the latch arm 131. In another alternative, the latch arm biasing device 126 can be a substantially linear acting biasing device that is located between the slider 140 and the latch frame 121.

The button biasing device 154 can comprise a linear acting biasing device disposed in the button receptacle 155 and therefore between the release button 150 and the latch frame 121. The button biasing device 154 provides a biasing force that returns the release button 150 to a normal outwardly extending position. A person must push on the release button 150 in order to overcome the biasing force of the button biasing device 154.

The release button 150 further includes one or more guide projections 158 extending from the release button 150. The guide projections 158 are received in corresponding guide slots 159 in the button receptacle 155. The guide projections 158 and the guide slots 159 enable the release button 150 to move inwardly and outwardly but do not allow the release button 150 to rotate or move in other directions.

The slider 140 includes an arm channel 145 that receives and traps the latch arm 131. Therefore, the latch arm biasing device 126 pulls the slider 140 upward to a normal position, in the absence of any external force being placed on the slider 140 (see FIG. 6). When a downward force is placed on the slider 140, such as by a person, the arm channel 145 forces the latch arm 131 to pivot to a disengaged position (see FIG. 7).

FIG. 4 shows the latch arm biasing device 126 according to an embodiment of the invention. In this embodiment, the latch arm biasing device 126 comprises a rotationally acting biasing device, such as a coil spring including a leg 127*a* that engages the latch arm 131 and a leg 127*b* that engages the latch frame 121. A pivotal biasing force is placed on the latch arm 131 by the latch arm biasing device 126.

Figure 5:
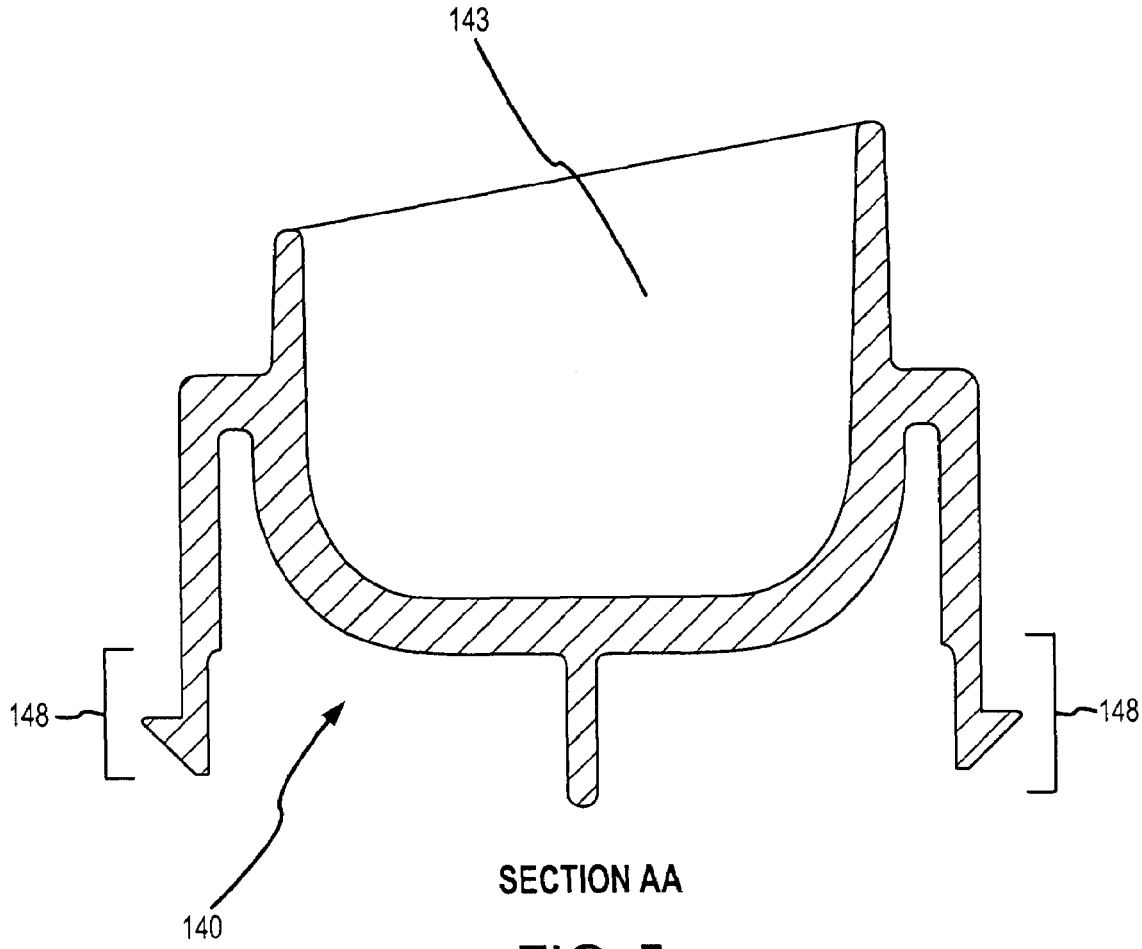
FIG. 5 is a cross-sectional view AA of the slider of FIG. 3.

FIG. 5 is a cross-sectional view AA of the slider 140 of FIG. 3. The figure shows retainer rails 148 that pass through the retainer slots 123 of the latch frame 121 and slidably engage the latch frame 121. As a result, the retainer rails 148 retain the slider 140 to the latch frame 121 while allowing the slider 140 to slidably move with respect to the latch frame 121.

Figure 6:
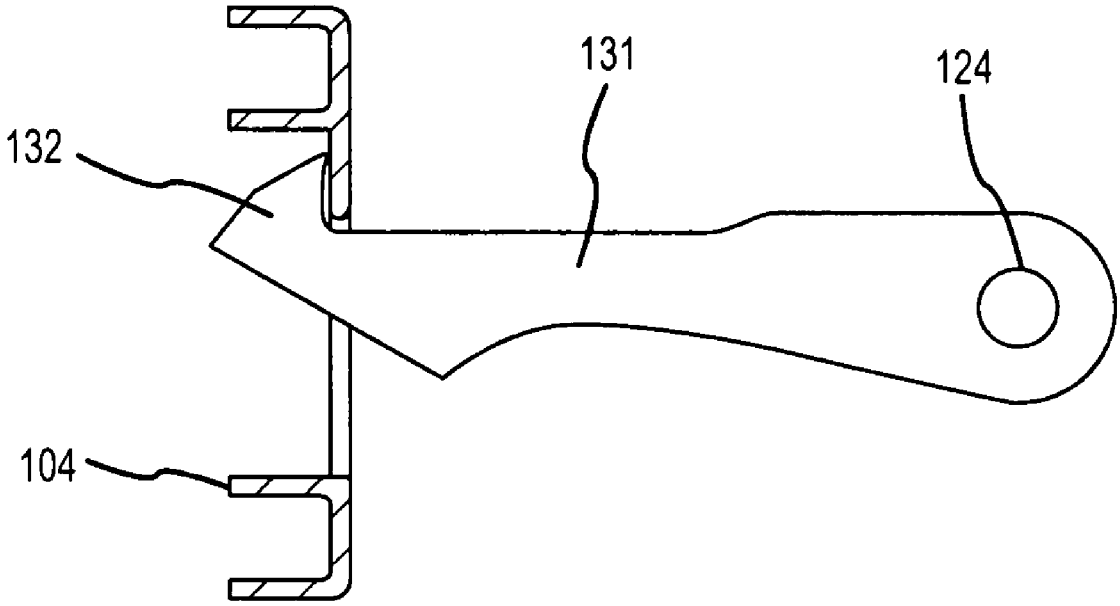
FIG. 6 shows the latch arm in a normal, upward position (i.e., a first, latched position).

FIG. 6 shows the latch arm 131 in a normal, upward position (i.e., a first, latched position). The latch projection 132 of the latch arm 131 can therefore engage a portion of the door 104, latching the door in a closed position. The latch arm 131 is configured to pivot at a pivot 124.

Figure 7:
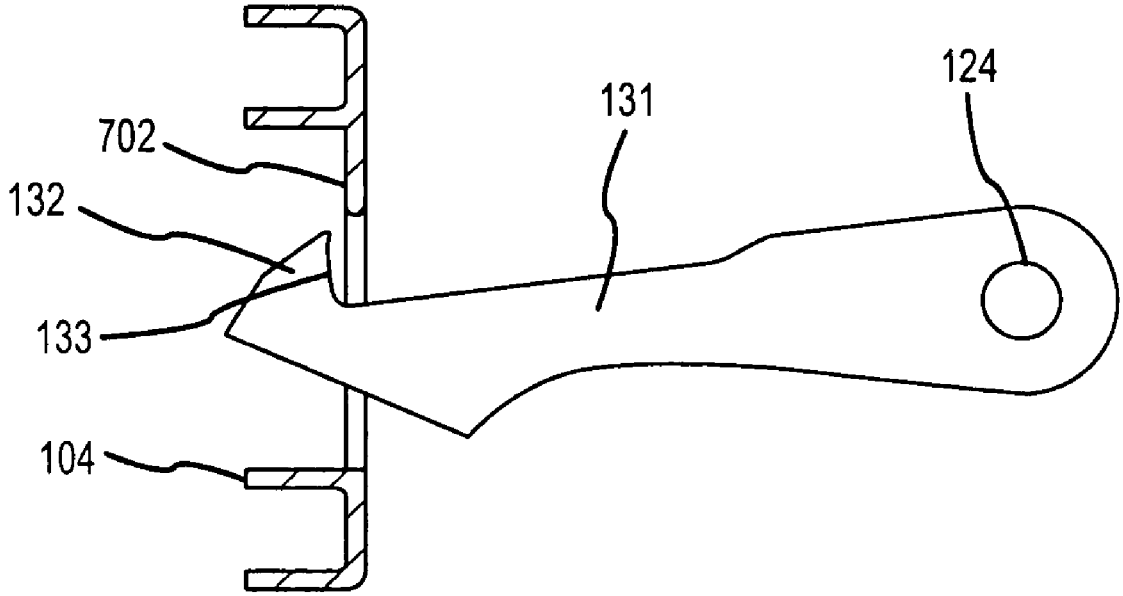
FIG. 7 shows the latch arm in a downwardly displaced position (i.e., a second, unlatched position).

FIG. 7 shows the latch arm 131 in a downwardly displaced position (i.e., a second, unlatched position). The latch arm 131 has been pivoted downward by the slider 140, against a biasing force provided by the latch arm biasing device 126. As a result, the latch projection 132 of the latch arm 131 is moved away from the door 104. The door 104 is therefore unlatched and can be opened.

The figure further shows a locking ramp 702 formed on the door 104. The locking ramp 702 fits to a matching angular face 133 in the latch arm 131. The locking ramp 702 frictionally engages the angular face 133. This frictional fit requires a predetermined amount of force to overcome. The locking ramp 702 therefore aids in preventing accidental or easy disengagement of the door safety latch 120.

Figure 8:
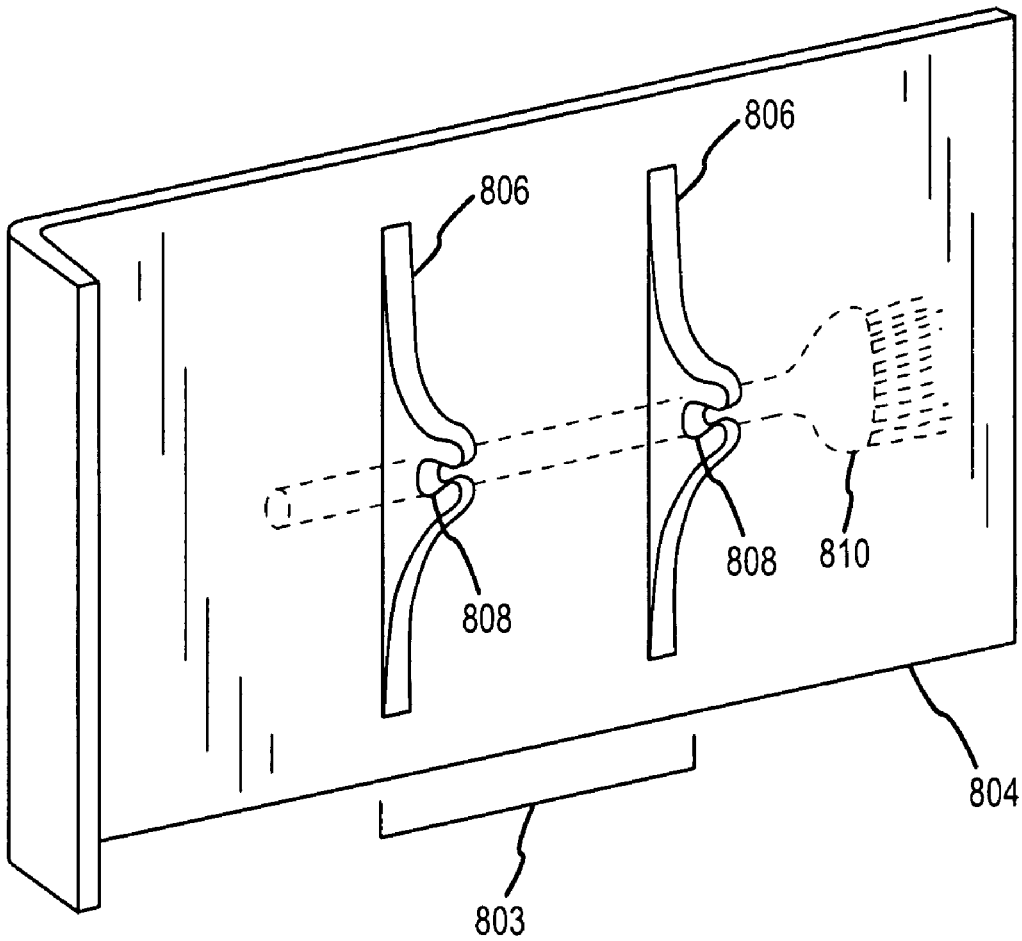
FIG. 8 shows an inner portion of a door including a tool holder.

FIG. 8 shows an inner portion of a door 804 including a tool holder 803. The tool holder 803 holds and retains a tool 810, such as a cleaning or servicing tool, for example. One or more tool holders 803 can be included on the door 804. In some embodiments, the door 804 comprises the air cleaner door 104 of the air cleaner 100 of FIG. 1. Alternatively, the door 804 can comprise a door of other air cleaner models. In some embodiments, the tool holder 803 comprises one or more tool retainer brackets 806. Alternatively, in other embodiments the tool holder 803 comprises any manner of pockets, snaps, straps, hook-and-loop straps, magnets, etc.

In one embodiment, the door 804 includes two or more tool retainer brackets 806. In one embodiment, the door 804 includes two or more substantially aligned tool retainer brackets 806. However, it should be understood that any number of tool retainer brackets 806 can be included on the door 804. As a result, one or more tools 810 can be conveniently stored against the surface of the door 804. The tool(s) 810 therefore will not be easily misplaced and will be conveniently available when needed.

A tool retainer bracket 806 can include a snap-in aperture 808. The snap-in aperture 808 can be sized to substantially receive a portion of a cleaning tool 810. The snap-in aperture 808 in the embodiment shown receives a portion of a handle of the cleaning tool 810. However, it should be understood that the snap-in aperture 808 can receive and hold any portion of the cleaning tool 810.

Figure 9:
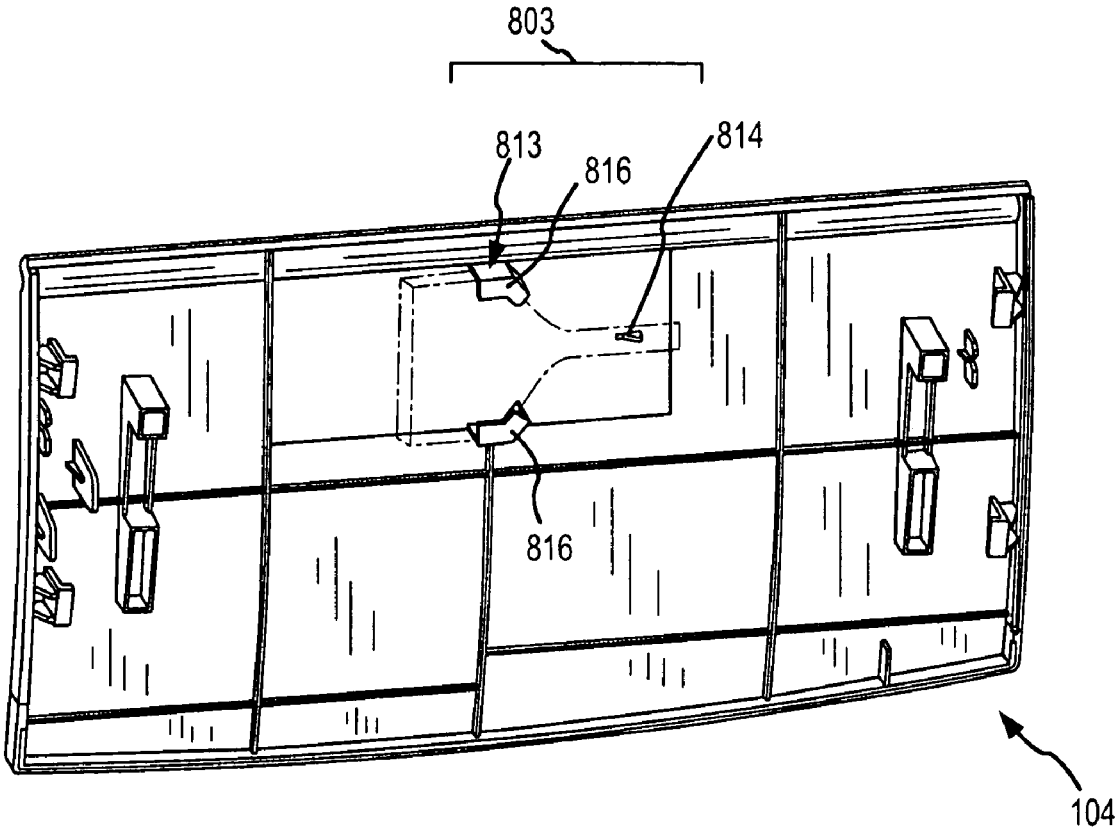
FIG. 9 shows the tool holder according to an embodiment of the invention.

FIG. 9 shows the tool holder 803 according to an embodiment of the invention. In this embodiment, the tool holder 803 comprises two tool retainer elements 813. The two tool retainer elements 813 comprise pockets that trap and hold the tool 810. The tool 810 can be slid into and out of place in the tool retainer elements 813. The tool holder 803 can further comprise one or more stand-offs 814 that force the tool 810 against plates 816 of the retainer elements 813. The tool 810 is therefore frictionally held in the tool holder 803.

What is claimed is:

1. A door safety latch for latching a door of an air cleaner, the door safety latch comprising:

a latch arm pivotally mounted between a latch position and an unlatch position, the latch arm including a latch projection adapted to engage the door;

a slider that is slidable and includes a slide arm for moving the latch arm toward the unlatch position; and a release button that is slidably movable and includes an operating surface at one end and a stop shoulder projecting from an end opposed to the operating surface, the release button being biased to a normally extended position with the stop shoulder positioned on the moving path of the slider to block movement of the slider and the latch arm to the second, unlatched position;

wherein the door safety latch is configured to receive a button depression on the operating surface of the release button, to move the stop shoulder out of a slide path of a slider of the door safety latch, and subsequently to receive a slide actuation force in the slider, with the slider pivoting the latch arm in order to release the engagement of the latch projection with the door of the air cleaner.

2. The door safety latch of claim 1, wherein the release button is first pushed and the slider is then slid to the second, unlatched position in order to release the door safety latch.

3. The door safety latch of claim 1, further comprising a button biasing device to bias the release button to the normally extended position.

4. The door safety latch of claim 1, further comprising a latch arm biasing device to bias the latch arm towards the first, latched position.

5. The door safety latch of claim 1, wherein the slider arm forms a latch arm channel in the slider, with the latch arm channel fitting over the latch arm.

6. The door safety latch of claim 1, further comprising a latch frame adapted to be affixed to the air cleaner, wherein the latch arm is pivotally mounted to the latch frame.

7. The door safety latch of claim 1, further comprising a latch frame adapted to be affixed to the air cleaner, wherein the latch arm is pivotally mounted to the latch frame, the slider is slidably affixed to the latch frame, and the release button is received in a button receptacle in the latch frame.

8. The door safety latch of claim 1, further comprising a finger well formed on the slider.

9. A method of forming and actuating a door safety latch for latching a door of an air cleaner, the method comprising:

providing a latch arm pivotally mounted between a latch position and an unlatch position, the latch arm including a latch projection adapted to engage the door, providing a slider that is slidable and includes a slide arm for moving the latch arm toward toward the unlatch position; and providing a release button that is slidably movable including an operating surface at one end and a stop shoulder projecting from an end opposed to the operating surface, the release button being biased to a normally extended position with the stop shoulder positioned on the moving path of the slider to block movement of the slider and the latch arm to the second, unlatched position;

wherein the door safety latch is configured to first receive a button depression on the operating surface of the release button, to move the stop shoulder out of a slide path of a slider of the door safety latch, and to subsequently receive a slide actuation force in the slider, with the slider pivoting the latch arm in order to release the engagement of the latch projection with the door of the air cleaner.

10. The method of claim 9, further comprising providing a button biasing device to bias the release button to the normally extended position.

11. The method of claim 9, further comprising providing a latch arm biasing device to bias the latch arm towards the first, latched position.

12. The method of claim 9, wherein the slider arm is provided with a latch arm channel in the slider, with the latch arm channel fitting over the latch arm.

13. The method of claim 9, further comprising providing a latch frame adapted to be affixed to the air cleaner, wherein the latch arm is pivotally mounted to the latch frame.

14. The method of claim 9, further comprising providing a latch frame adapted to be affixed to the air cleaner, wherein the latch arm is pivotally mounted to the latch frame, the slider is slidably affixed to the latch frame, and the release button is received in a button receptacle in the latch frame.

15. The method of claim 9, further comprising providing a finger well on the slider.

* * * * *